United States Patent [19]

McCain et al.

[11] 4,162,066

[45] Jul. 24, 1979

[54] SIGNATURE MACHINES

[75] Inventors: William B. McCain, Hinsdale; James F. Cosgrove; John Vente, both of Western Springs; Thomas R. Flavin, Mokena, all of Ill.

[73] Assignee: McCain Manufacturing Corporation, Chicago, Ill.

[21] Appl. No.: 803,750

[22] Filed: Jun. 6, 1977

[51] Int. Cl.[2] ..... B65H 39/02

[52] U.S. Cl. ..... 270/54; 271/96

[58] Field of Search ..... 270/54–57, 270/69, 60; 101/232; 271/90–92, 96, 108

[56] References Cited

U.S. PATENT DOCUMENTS

| | | | |
|---|---|---|---|
| 2,855,195 | 10/1958 | Young | 270/54 |
| 3,916,790 | 11/1975 | Alix | 271/96 |
| 3,949,978 | 4/1976 | Swanson | 270/54 |

*Primary Examiner*—Edgar S. Burr
*Assistant Examiner*—A. Heinz
*Attorney, Agent, or Firm*—Kinzer, Plyer, Dorn & McEachran

[57] ABSTRACT

Signature feeding machine operable in a run mode or jog mode and having means to time differently the application and disapplication of vacuum to an extractor in accordance with the modes.

6 Claims, 8 Drawing Figures

10
8
20
27
12
12-1
28
32-A
32-2
26
29
36
31
48-H
18
22
32-A
32-1
75
30
24
48
38
40
45
42
44
46
50
72
62-1
62-A
32-3
70-1
71
14
66
80
16
78
64
65
62-2
69
67
68
62-5
70-2
74
8 fig. 2.
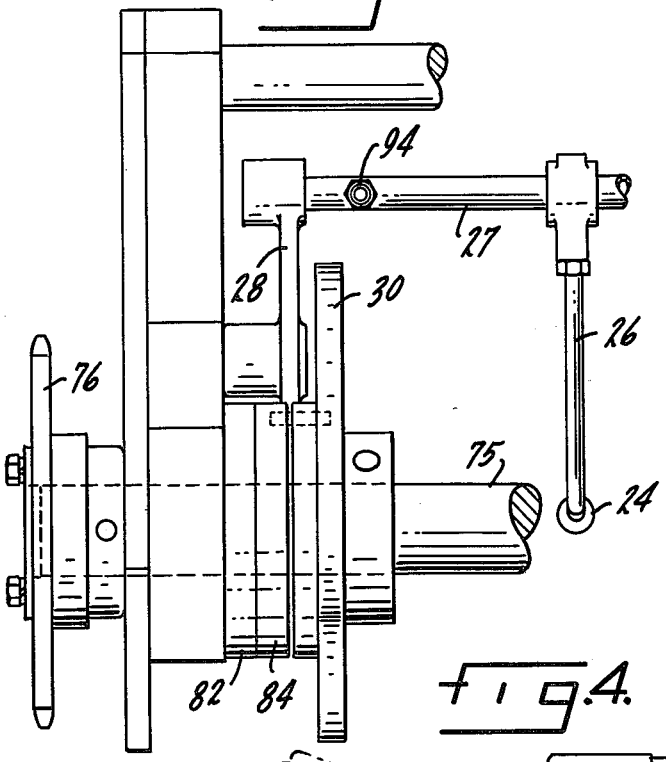
fig. 3.
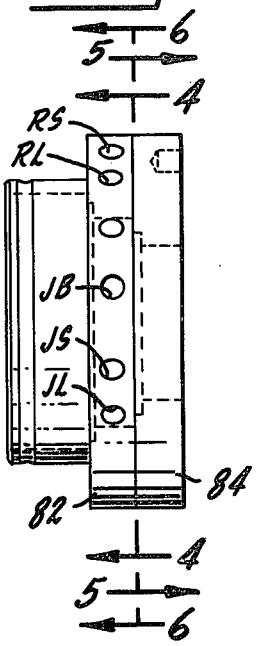
fig. 4.
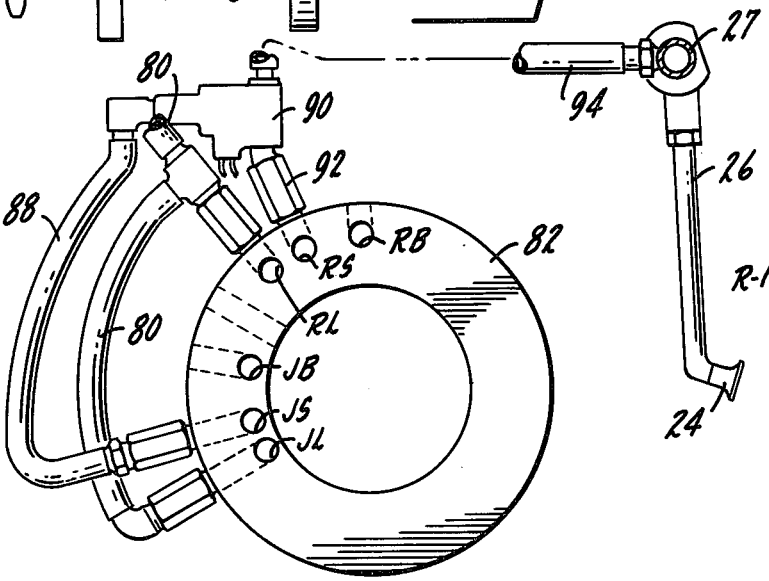
fig. 5.
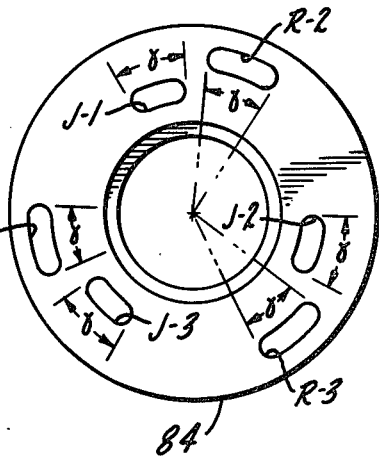
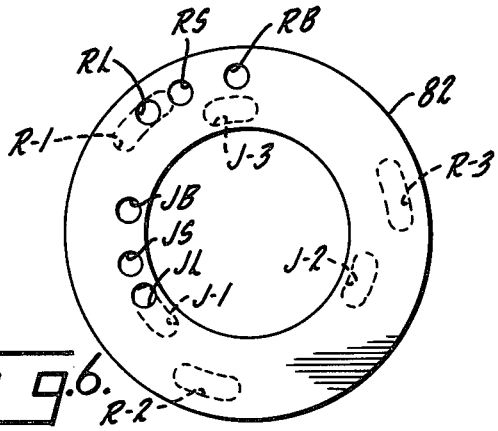
fig. 6.
fig. 7.
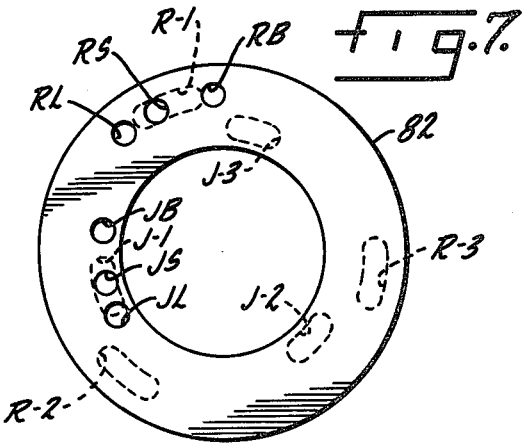

SIGNATURE MACHINES

This invention relates to signature gathering and in particular to a signature feeding machine for extracting a signature from a hopper and dropping it on a conveyor. The disclosure specifically concerns a machine for feeding a saddle gatherer or conveyor but some principles of the invention are equally applicable to flat gathering.

A machine of the foregoing kind (for saddle gathering) typically may include a suction gripper, mechanical grippers on an extracting cylinder, and mechanical grippers both on a lap cylinder and an opening cylinder, which cooperate first to present the signature to the extracting cylinder, to fully extract a signature from the hopper and thereafter to open the pages so the signature may be dropped in straddle relation on a saddle conveyor, along with other signatures handled in a similar fashion to complete a book, usually a stitched back book.

A book is simply a collection of signatures, regardless of the number of signatures and regardless of the manner in which the book is bound. A signature, in the simplest form, is a folded sheet. If it is folded off-center it has a short leg and a longer leg, the latter presenting what is known as a lap margin.

Our company on several occasions has addressed itself to improving productivity in the production of books using grippers on an extracting cylinder. In U.S. Pat. No. 3,565,422 for example, there was an effort to enlarge productivity by increasing the number of grippers on the extracting cylinder from two to three (an increase of fifty percent) with the intention of correspondingly increasing the speed of the lap and opening cylinders, in order to keep pace.

In principle the idea of increasing from two to three the number of signatures handled during one turn of the extracting cylinder is correct but when the speed of the lap and opening cylinders is increased all sorts of difficulties are encountered due to the increased velocity. It is not the increased velocity of the parts of the machine which present difficulty, rather the increased velocity of the paper, paper dynamics indeed. Thus, nearly all the equations involving resistances and impedances encountered by the paper signatures involve the exponential factor of $v^2$ ($v$=velocity). The resistances and impedances involve such things as the kinetic energy of the paper in motion, the air foil character of the signature in motion, centrifugal force, uniform acceleration, air resistance and so on. This explains why we found disadvantages and not advantages when increasing the velocity of the lap and opening cylinders to keep pace with the increased amount of paper when increasing the number of grippers on the extracting cylinder.

It was a realization of the adverse effect of the $v^2$ factor which prompted the thought that the way to handle signatures delivered by a three gripper extracting cylinder was to slow the lap and opening cylinders, not speed them up, and to handle the increased delivery from the extracting cylinder (three sheets instead of two per cycle) by a second gripper on each of the lap and opening cylinders.

Accordingly, an object of the present invention is to be able to accomodate an increased rate of signature extraction without having to increase the speed of the lap and opening cylinders and more specifically it is an object of the present invention to accomplish this by actually slowing the speed of the lap and opening cylinders by adding an extra gripper to each one, allowing the speed of the lap and opening cylinders to be decreased with the result that the delivery rate is increased while actually slowing the speed.

Experience has established that the superior way to extract a signature from a supply hopper, incidental to finally delivering it to a saddle conveyor, is by way of oscillating suction grippers which are effective to clamp a signature by vacuum and pull it out of the hopper in position to be grabbed by the gripper on the extracting cylinder. In actual practice there may be as many as thirty or forty signature feeders in a row, each feeding the saddle or gathering chain. As can be imagined it is sometimes necessary to stop the machine in order to clear a jam in one of the signature feeders and this indeed may entail a prolonged effort to identify the source of the problem during machine shut-down. In accomplishing the repair it is sometimes necessary to "jog" the pocket feeder in order to identify the source of the problem causing the paper jam. It is therefore customary for the manufacturer of the signature feeder to provide for two different controls, namely, a continuous or un-interrupted mode and a discontinuous or jog mode. The signature feeder of the present invention, as may be inferred from the foregoing, is characterized by an extracting cylinder having three grippers spaced equidistantly about the circumference. There is a very brief interval between the time a signature is pulled from the hopper, by means of the suction extractor, and the time when the backbone of that signature is grabbed by a gripper on the extracting cylinder. In accomplishing this movement, that is, the movement of the signature from the supply hopper into position to be grabbed by the gripper, vacuum must first be applied, held and then disapplied so that the vacuum grip is discontinued at the moment the mechanical gripper is actuated.

Provision must therefore be made to disapply vacuum before the mechanical gripper is actuated and to re-apply the vacuum neither too late nor too soon with respect to the next signature to be extracted from the supply hopper. In the ordinary machine, where there are one or two grippers on the extracting cylinder with proportionally reduced speed, the movement of the suction gripper, back and forth, is considerably less critical in timing than where there are three grippers and our realization of this fact lead to the discovery of the problem and its answer. Thus, with the machine in a jog mode nearly all the inertia of an idle machine prevails, but when the suction fingers are oscillating with great speed in the run mode to feed the mechanical grippers (indeed fifty percent faster than heretofore with a two gripper cylinder) the timing of application and disapplication of the vacuum is quite critical, which explains why we found signatures being mishandled in the run mode but not in the jog mode. We found the other way around to be also true: timing for the run mode distorted the jog mode, which is to say that when the machine is placed in the jog mode, which is necessary for trouble shooting, the vacuum timing which prevailed in the run mode was obscuring identification of the real problem.

Accordingly another object of the present invention is to enable a machine of the foregoing kind, that is, a signature feeding machine, to be timed differently, in two different modes of operation, from the standpoint of application and disapplication of vacuum (negative pressure) prevailing in the suction means used to extract the signatures from the hopper and present each signature properly to the mechanical gripper supported on the rotating extracting cylinder. More specifically it is an object of the present invention to be able to select between two rotary valves which time the application (and disapplication) of the vacuum differently for the respective run and jog modes.

The term "jog" is employed in the express dictionary sense, meaning to cause the machine to operate for an instant as by a button which permits momentary operation of the motor. In comparison, the machine is otherwise in its "continuous run" mode, that is, no discontinuity in repeated machine cycles or portions thereof.

IN THE DRAWING

FIG. 2 is a detail view of vacuum valving parts;

FIG. 3 is a sub-assembly view of parts shown in FIG. 2;

FIG. 4 is a view on the line 4—4 of FIG. 3 with some hoses connected in place;

FIG. 5 is a view on the line 5—5 of FIG. 3;

FIGS. 6 and 7 are taken on the line 6—6 of FIG. 3;

Figure 1:
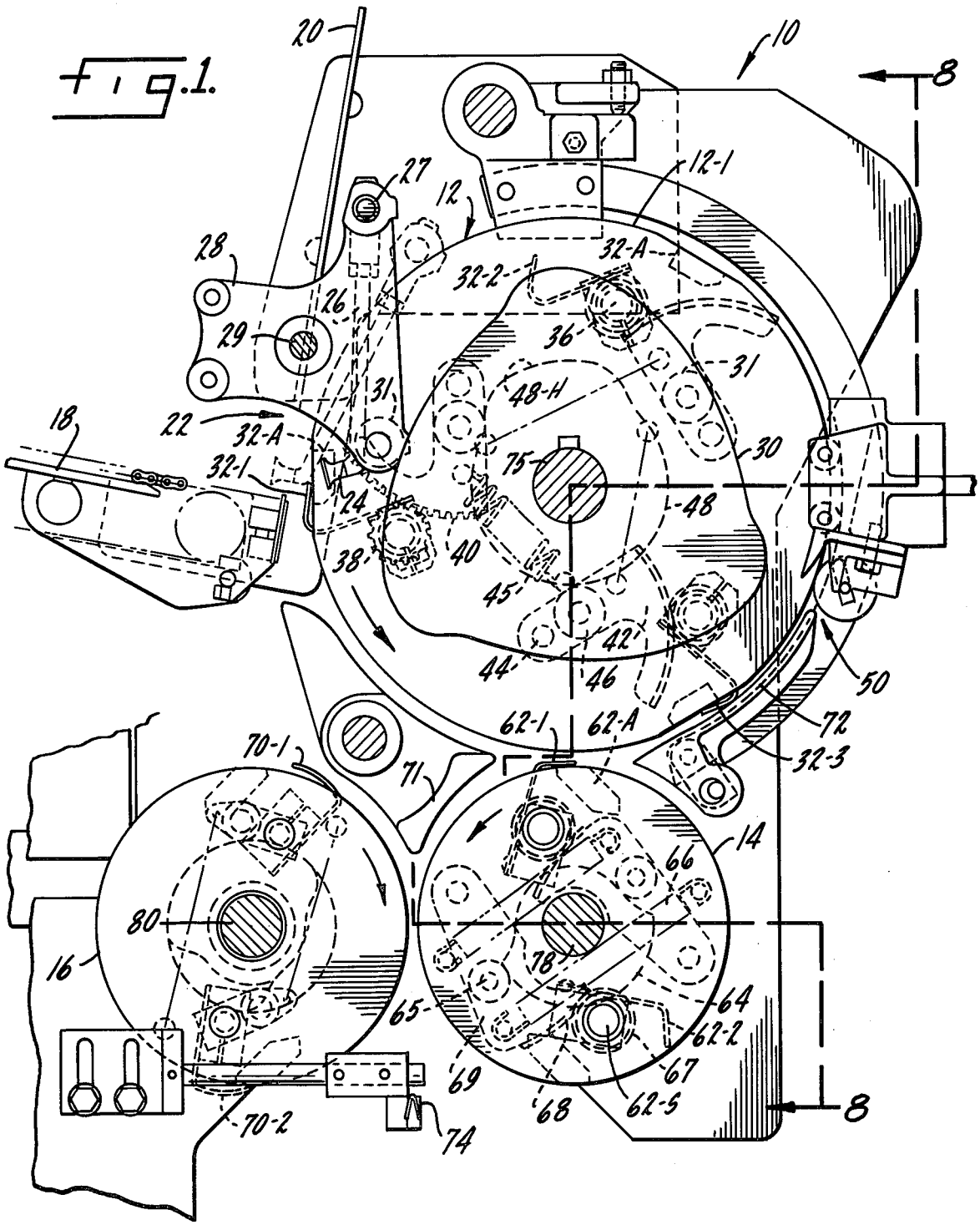
FIG. 1 is a side elevation of the machine with parts in section.

The signature feeding machine 10, FIG. 1, comprises an extracting cylinder 12 positioned above a lap cylinder 14 and an opening cylinder 16.

The signatures are stacked in a hopper 18 with their backbones down and with the short sheet front-most so that for the leading signature, next to be extracted, its short sheet reposes against the front plate 20 of the hopper while its backbone (fold) is at the throat (opening) 22 at the bottom of the hopper, in position to be grabbed by one of several suction grippers 24.

Each suction gripper is carried at the lower end of a hollow stem 26 depending from a horizontal, hollow support rod 27 which also serves as a suction manifold for communicating vacuum to the suction grippers.

The support rod 27 is carried by an oscillating bell-crank 28 pivoting at 29. The bell-crank is oscillated by a three lobed cam 30 engageable with a cam follower 31 secured to the bell-crank 28 so that the suction grippers are caused to swing in and out relative to the throat of the hopper. When the suction gripper swings in, it contacts the forwardmost signature in the hopper and grips it by suction; during the reverse or outward stroke the suction gripper presents the backbone of the withdrawn signature to the periphery of the extracting cylinder.

Cam 30 rotates with the extracting cylinder and actuates the suction grippers three times for each turn of the extracting cylinder, transferring three signatures for each turn of the extracting cylinder.

The extracting cylinder rotates counterclockwise as viewed in FIG. 1. It carries three gripper fingers 32-1, 32-2 and 32-3 equidistantly spaced about the circumference thereof, each secured to a rod 36 (three rods in all) in turn supported by the cylinder 12 for revolution therewith. The term "extracting cylinder" is a term of art; it actually comprises two spaced discs 12-1 and 12-2, FIG. 8, each equipped with the three grippers, and a third disc 12-3 carrying the segment gear rockers described below.

The rods 36 are rotatable and each has a pinion 38 at one end, engaged with a segment gear 40. Each segment gear is part of a rocker 42, pivotally supported at 44 on the extracting cylinder, and biased by a spring 45.

Each segment gear rocker has a cam follower 46 in position to ride on a stationary timing control cam 48 coaxial with the extracting cylinder. Cam 48 has a single lobe and a single dwell so that cam 48 and the cooperating springs 45 are effective to open and close the respective grippers 32-1, 32-2 and 32-3. The spring tends to close the gripper; the high part 48-H of cam 48 rocks the gear segment to open the gripper.

Finger 32-1 is shown in FIG. 1 in its closed position, effective to clamp the backbone of an extracted signature against a cooperating anvil 32-A, transporting the signature counterclockwise in the direction of a register gauge 50, with the backbone in leading position. This closing of the gripper, to extract, is a critical feature of timing and is unchangeable regardless of signature length.

Another critical feature of timing is that the grippers on the extracting cylinder must be open when the backbone of the signature reaches the register gauge which is pre-positioned depending on the length of the signature. The register gauge will be so positioned that the signature released thereto will have its lap drooping in contact with the periphery of the lap cylinder 14.

The cam 48 will be positioned initially at the time of installation so the grippers will close properly on the backbone presented by the suction disc. Likewise, the register gauge will be properly adjusted. Then, an adjustable cam patch 52, FIG. 8, keyed to cam 48 is turned to lengthen or shorten the effective cam dwell surface (depending on signature length) to allow the grippers to be opened by the cam lobe 48-H just when the signature backbone is at the register gauge; the grippers remain open with the cam follower 46 riding on the cam lobe until they are once more back on the hopper side when the cam follower rides off the cam lobe, allowing the spring to close the gripper.

Figure 8:
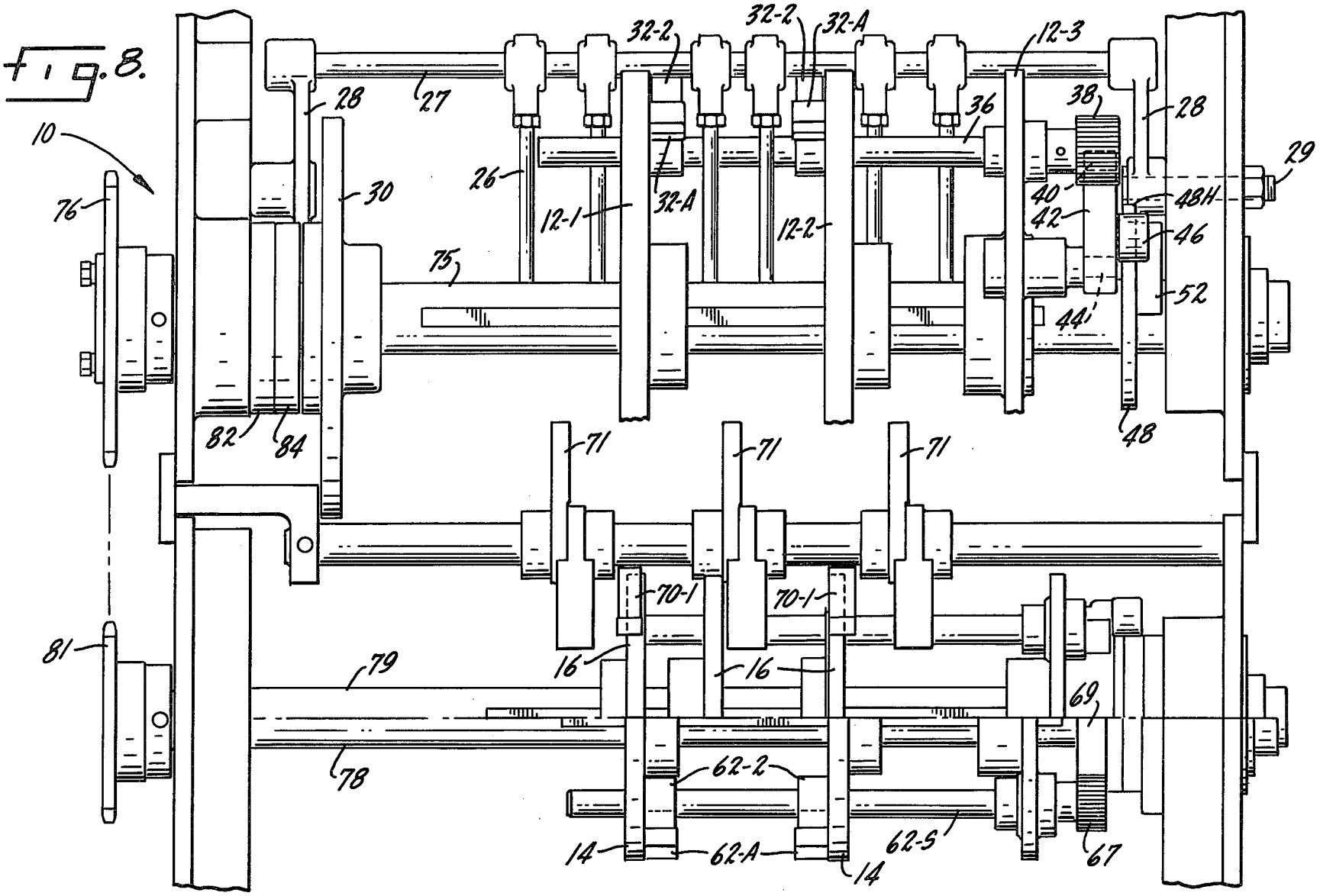
FIG. 8 is a view taken on the line 8—8 of FIG. 1.

When the signature is released to the register gauge, its extended, free lap margin is presented to the lap cylinder 14 and more specifically dangles in the six o'clock position to be grabbed by either one of two gripper fingers 62-1 and 62-2 carried by the lap cylinder 14 in 180° displaced positions. The lap cylinder is equipped with actuating means to open and close the lap gripper fingers, operating in a manner identical to the extracting cylinder grippers as can be seen from the timing control cam 64, follower 65, spring 66, pinion 67, segment gear 68, and segment gear rocker 69 for each set of lap grippers. The lap gripper fingers are carried on a shaft 62S having the gear 67 at one end as shown in FIG. 8. Thus, a lap cylinder gripper is effective in timed relation at its twelve o'clock position to clamp the lap of the signature, positioned in the register gauge, against an anvil as 62A, withdrawing the signature from the register gauge leftward as viewed in FIG. 1, beneath the lower surface of a guide 71. The upper surface of guide 64 serves as a guide for the signature during its transit from the hopper to the register gauge; a second guide 72 near the register gauge serves the same purpose, guiding the signature into and out of the register gauge.

The opposed opening cylinder is also provided with a pair of 180° displaced, finger-like grippers 70-1 and 70-2, operating and timed in the manner of those on the lap cylinder as can be readily seen. In this connection it will be recalled the effective surface on cam 48 can be varied by the cam patch 52; similar cam timing patches are afforded for the lap and opening grippers.

The lap cylinder rotates counterclockwise, the opening cylinder rotates clockwise. As already noted, one set of the grippers on the lap cylinder (say 62-1) is effective to clamp the lap of the signature, moving the signature toward the bight between cylinders 14 and 16, and as the bight is attained the opposed fingers on the opening cylinder (say 70-1) are interdicted between the signature sheets, closing at the three o'clock position; thereafter fingers 62-1 and 70-1 cooperate to spread the signature sheets out more and more until the divergence is adequate to assure the signature will straddle the saddle 74. Preferably the lap and opening grippers are opened at their six o'clock position.

The cams on the lap and opening cylinders, which control their grippers, are also adjusted at the time of installation so the action of those grippers will be timed to the gripper on the extracting cylinder.

During one 360° turn of the extracting cylinder, three signatures are withdrawn one by one in sequence from the hopper and released to the register gauge. When the lap gripper picks up a signature in the signature gauge, the next or following signature is already on its way toward the register gauge.

As shown in FIG. 8, the extracting cylinder is supported on a drive shaft 75 having a sprocket 76 driven by a chain (not shown). The lap cylinder is supported on a drive shaft 78 and the opening cylinder is supported on a drive shaft 79, each having a sprocket as 81 driven by the same chain.

It may seem parts are merely being multiplied. That is by no means the case as will now be explained. In the known machine there were two grippers on the extracting cylinder separated by approximately 17.3 inches for a total circumference of 34.6 inches. There was only one gripper on each of the lap and opening cylinders, each of these cylinders having a circumference of about 17.3 inches. In a machine of this character, the base or index can be taken as the rate of the stitcher head where the books are stitched. Assuming a stitcher head rate of 225 books per minute, the rate of paper dropped on the saddle (and into the register gauge as well) would be $17.3 \times 225 = 3890$ linear inches per minute, which was the approximate maximum rate of the known machine because of the $v^2$ factor involving paper dynamics.

In the present machine, the three extracting grippers are spaced by 13.1 inches (39.3 inches circumference) and those on the lap and opening cylinders are separated by 11.9 inches (23.8 inches circumference). Assuming a $v^2$ value of one (velocity = 1) for paper dynamics in the known machine, the following chart shows how that value is reduced considerably under the present invention:

| Machine | Cycles/min. | $v_2$ (at the register gague) | $v^2$ (at the saddle) |
|---|---|---|---|
| Known | 225 | 1 | 1 |
| Present | 225 | 0.6 | 0.47 |
| | 275 | 0.86 | 0.70 |
| | 300 | 1.02 | 0.84 |

The $v^2$ factor features constantly: accelerating paper from the hopper, throwing it into the register gauge, re-accelerating it out of the register gauge, opening the pages and finally allowing it to drop on the gathering chain. In effect the linear velocity of paper between the supply hopper and the gathering chain is slowed but the number of signatures delivered per unit of time is increased.

It can be recognized from FIG. 1 that the grippers are closely spaced, leaving both little space and little time for reciprocating the sucker head 24, cycling the suction on and off, and closing of the gripper, which are events of critical importance at the throat of the hopper. If there is not precise coordination the signature will be torn or missed during the continuous run mode. Thus, the suction must be fully released when the grippers as 32-1 clamp the backbone of the signature to the anvil 32-A.

To enable the two modes of operation to be handled (run mode; jog mode) two separate valving means are employed for cycling the vacuum, preferably rotary valves. Thus, referring to FIGS. 2 through 7, vacuum is effective at all times in a hose 80 and is continuously communicated to two receiving ports RL and JL (R for "run"; J for "jog") provided in a stationary porting disc 82, which is co-axial with drive shaft 75, located at the side of the machine near the drive sprocket 76. A second disc 84 is keyed to cam 30 for rotation therewith synchronously with the extracting cylinder and fits snugly against disc 82 in sealed relation.

Disc 84 is a valving disc, formed in the face next to disc 82 with a first series of equidistantly spaced segmental valve slots R-1, R-2 and R-3 (R for "run") arranged on a radial outward circle, and a second series of equidistantly spaced segmental valve slots J-1, J-2 and J-3 (J for "jog") arranged in a radial inward circle. There are three valving slots (segment angle alpha) accordingly as there are three sets of grippers on the extracting cylinder.

The stationary porting disc 82 is provided with a pair of vacuum transfer ports RS and JS. Port JS is communicated to a hose 88 in turn connected to a solenoid-operated valve 90. Port RS is connected by a coupling 92 to valve 90. Valve 90, in turn is connected by a hose 94 to the manifold pipe 27 which services the sucker heads.

The solenoid valve is a selector enabling vacuum to be handled selectively for the two modes: it is open during the run mode to discommunicate port JS with the vacuum and closed during the jog mode to discommunicate port RS with the vacuum. Thus, in each mode vacuum will be effective at either port RS or port JS but not the other port.

There is one bleed port (bleed to atmosphere) RB and a second bleed port JB in disc 82 for releasing the vacuum prevailing in the sucker head manifold 27.

The ports are so spaced and the valve slots of such length that a valve slot can span two adjacent ports but not three, thereby to communicate a vacuum transfer port to either the vacuum receiving port or the bleed-to-atmosphere port.

Referring to FIGS. 6 and 7 (both taken in the direction of the arrow 6—6, FIG. 3, so the valving slots may be viewed as juxtaposed on the ports of disc 82 in the operative state) it will be noted the leading edge of valve slot R-1 has just touched port RS to establish communication with port RL where vacuum prevails, meaning vacuum is started to the sucker heads, assuming the run mode prevails; in FIG. 7, the same valve slot has afterwards just attained port RB to communicate the sucker heads to atmospheric pressure in the run mode.

The condition is slightly different for the jog mode valve slots; they "lag" the run mode by a predetermined angle, say 5° to 10°. Thus, in FIG. 6, the leading edge of slot J-1 would be communicating with port JL, not yet having attained port JS at a time when vacuum would already have prevailed at the sucker heads in the run mode. Similarly, FIG. 7, the leading edge of slot J-1 would be displaced from the bleed-to-atmosphere port JB at the time when atmospheric pressure would already have started to prevail at the sucker heads in the run mode.

The net effect is vacuum is discontinued at the sucker heads in their movement toward the extracting cylinder, to release the signature, sooner than in the jog mode. Similarly, during the return stroke of the sucker stems toward the pile of signatures in the hopper, vacuum is sooner applied than in the jog mode.

We prefer to employ a dual, selectable rotary valve for varying the time of applying and disapplying negative pressure in accordance with two basic modes of machine operation because we can thereby synchronously harness the rotary input to the extracting cylinder. Nonetheless, a linear slide valve presenting equivalent porting could conceivably be used. Because a rotary valve can thus be easily made self-synchronizing it would be possible to dispense with one series of valve slots in disc 84 while making provision to automatically turn disc 84 selectively in one direction or the other by an angle proportional to machine speed, as by a governor responsive to speed of the extracting cylinder, in which event there may be more than two settings but nonetheless inclusive of a jog mode as the slowest.

The valving principle could also be incorporated in a flat gathering machine where again signatures may be pulled one by one from a hopper by an oscillating vacuum disc which presents the signature in sequence to spaced gripper means on a rotary extracting cylinder which in turn release the signatures for gravity drop on to a so-called flat or side gathering conveyor, without intervention of a lap and opening cylinder which characterize a saddle conveyor for signatures.

We claim:

1. In a cyclically operable signature feeding machine, where signatures each having a sheet with a lap margin and a short leg sheet attached by a fold to a backbone, are extracted in successive machine cycles one by one from a supply hopper and are transported sequentially by grippers on a rotatable extracting cylinder to a register gauge where they are released with the backbone adjacent the register gauge, whereafter each signature thus released is withdrawn from the register gauge and then opened, so its sheets are spread apart, by opposed grippers respectively carried by a rotatable lap cylinder and an opposed rotatable opening cylinder preliminary to dropping the opened signature in straddling relation on a saddle conveyor:

said extracting cylinder having three sets of grippers spaced equidistantly about and supported on the circumference thereof, and actuating means operable to open and close the grippers;

each of the lap and opening cylinders having two sets of grippers supported thereon and spaced approximately 180° apart, together with actuating means operable to open and close those grippers;

timing means for synchronizing operability of the second-named actuating means to the operability of the first-named actuating means so that as a set of grippers on the lap cylinder closes on the lap margin of a signature already released to the register gauge a set of grippers on the extracting cylinder has closed on the backbone of a signature extracted from the hopper and is transporting it to the register gauge;

extraction means for extracting the signatures from the hopper by applying negative atmospheric pressure thereto and, in timed relation, for releasing an extracted signature to a related gripper means on the extracting cylinder by applying atmospheric pressure; and means connected to the extraction means to advance the time for both applying negative pressure and atmospheric pressure when the machine cycles are repeated in a continuous run mode of the machine compared to discontinuous cycles when the machine is in a jog mode.

2. A machine according to claim 1 including one valve means operable to time both the application of negative pressure and application of atmospheric pressure when the machine cycles are repeated during a continuous run mode and other valve means operable to time differently both the application of negative pressure and atmospheric pressure when the machine cycles are discontinuous in a jog mode; and a selector to select one of the valve means in accordance with the mode.

3. A machine according to claim 2 wherein each valve means is in the form of a set of three equidistantly spaced segmental valve slots located on respective concentric circles in a rotary valve disc engaging a stationary porting disc, said porting disc, for each valve means, having a receiving port for negative atmospheric pressure, a transfer port for transferring the received pressure to the said extraction means and a bleed port for communicating atmospheric pressure to said transfer port, one set of valve slots lagging the other by a predetermined angle.

4. A machine according to claim 3 in which the selector is a solenoid valve to which each of the transfer ports is connected, the solenoid valve in turn being connected to the extraction means so that both forms of pressure are relayed to the extraction means by the solenoid valve.

5. In a cyclically operable signature feeding machine, where signatures are extracted one by one from a supply hopper in successive machine cycles and are transported sequentially by gripper means on a rotatable extracting cylinder to a predetermined release point where they are released:

extraction means for extracting a signature from the hopper by communicating negative atmospheric pressure thereto at a predetermined time and for releasing the thus extracted signature to the gripper means on the extracting cylinder by next in time communicating to said extracted signature atmospheric pressure;

a pair of selectable mutually exclusive valve means respectively operable each to alternate communication of negative and atmospheric pressure to said extraction means at different times when the machine cycles are repeated in a continuous run mode of the machine compared to discontinuous cycles when the machine is in a jog mode, the time for application of negative pressure and atmospheric pressure in the continuous mode occurring sooner than the time for applying negative pressure and atmospheric pressure in the jog mode;

and a selector to select the respective valve means.

6. A machine according to claim 5 including a rotary valve disc, synchronized rotatably with the extraction cylinder, said valve means being constituted by two sets of segmental valve slots in the valve disc respectively to time application of negative and atmospheric pressure at predetermined angles different for the two modes.

* * * * *